US007823525B2

(12) United States Patent
Brown et al.

(10) Patent No.: US 7,823,525 B2
(45) Date of Patent: Nov. 2, 2010

(54) FLOATING PLATFORM METHOD AND APPARATUS

(75) Inventors: Neal A. Brown, San Diego, CA (US); Donald A. Innis, San Diego, CA (US)

(73) Assignee: Float, Incorporated, San Diego, CA (US)

( * ) Notice: Subject to any disclaimer, the term of this patent is extended or adjusted under 35 U.S.C. 154(b) by 883 days.

(21) Appl. No.: 11/569,869

(22) PCT Filed: Jun. 9, 2004

(86) PCT No.: PCT/US2004/018687

§ 371 (c)(1),
(2), (4) Date: Nov. 30, 2006

(87) PCT Pub. No.: WO2006/001796

PCT Pub. Date: Jan. 5, 2006

(65) Prior Publication Data

US 2009/0173269 A1 Jul. 9, 2009

(51) Int. Cl.
*B63B 35/44* (2006.01)

(52) U.S. Cl. ..... 114/264; 114/267

(58) Field of Classification Search ..... 114/258–267, 114/78, 121–125
See application file for complete search history.

(56) References Cited

U.S. PATENT DOCUMENTS

| | | | | |
|---|---|---|---|---|
| 3,490,407 | A * | 1/1970 | Dempster | 114/264 |
| 3,833,035 | A | 9/1974 | Yee | |
| 4,261,277 | A | 4/1981 | Bergman | |
| 4,864,958 | A | 9/1989 | Belinsky | |
| 5,235,929 | A * | 8/1993 | Chester et al. | 114/266 |
| 5,375,550 | A * | 12/1994 | Innis | 114/267 |
| 6,213,045 | B1 * | 4/2001 | Gaber | 114/266 |
| 6,742,458 | B2 | 6/2004 | Henderson | |
| 6,791,206 | B1 | 9/2004 | Woodbridge | |
| 2003/0140838 | A1 | 7/2003 | Horton, III | |
| 2003/0221603 | A1 * | 12/2003 | Horton | 114/264 |

* cited by examiner

*Primary Examiner*—Daniel V Venne
(74) *Attorney, Agent, or Firm*—Schwabe, Williamson & Wyatt

(57) ABSTRACT

A floating platform is provided. The floating platform includes a top surface (14), a plurality of buoyancy members (12) interconnected to the top surface and extending downwardly into a body of water, a bottom plate (16) and a plurality of interstitial volumes (24) that are sealed at a bottom end by the bottom plate to prevent the flow of water into the interstitial volume.

20 Claims, 3 Drawing Sheets

FIG. 3
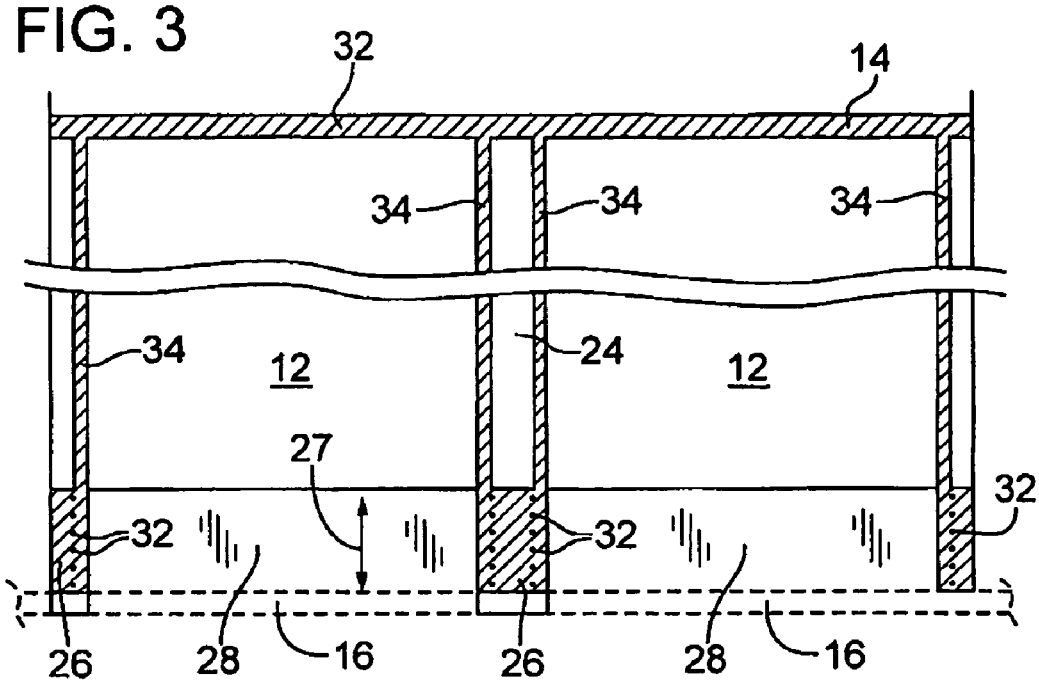
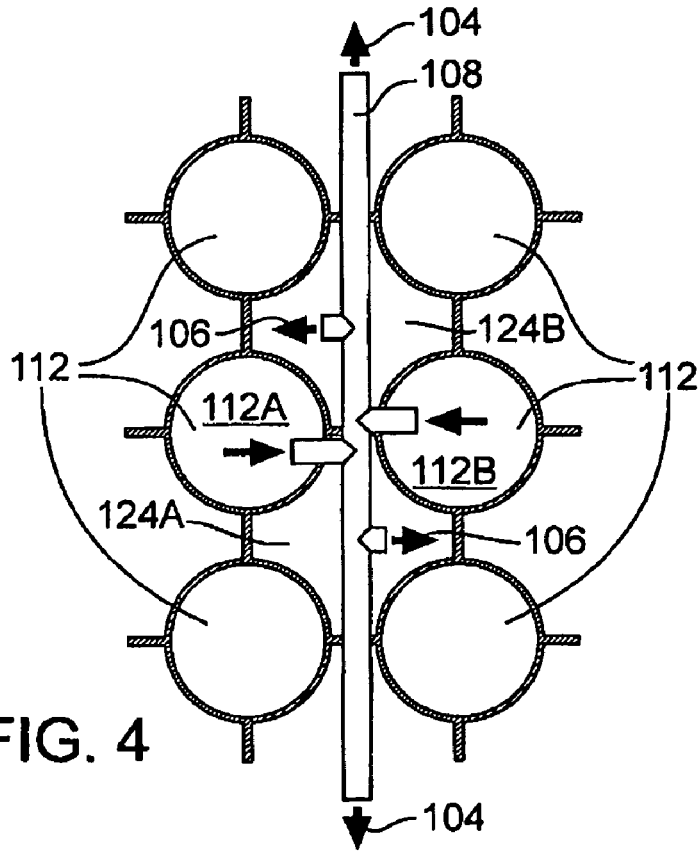
FIG. 4

FLOATING PLATFORM METHOD AND APPARATUS

FIELD OF THE INVENTION

Disclosed embodiments of the invention relate to the field of large floating platforms, and more particularly, embodiments of the invention relate to a floating platform apparatus and configuration for enhanced platform stabilization and structural support.

BACKGROUND OF THE INVENTION

Large area floating structures are useful for providing enlarged areas for a number of large scale operations, such as: offshore petroleum drilling, production and storage; liquefied natural gas on-loading and storage, re-gasification, pressurization and off-loading; electric power plants, both hydrocarbon and nuclear fueled; de-salination water plants; airports, seaports, military bases, living accommodations, floating piers, breakwaters, harbors and the like.

Such structures are most economically fabricated in prestressed, steel reinforced concrete composites. Such large area structures are typically tightly coupled by buoyancy to the water surface, and waves can impart undesirable motions and induce undesirable dynamic and static stresses in the structures. Because concrete structures are susceptible to failure when stressed in certain ways, these structures stresses must be mitigated. To adequately mitigate these stresses, ways to enhance de-coupling of the floating structures from the buoyant excitation by sea waves must be employed.

Floating structures for large-scale operations may be similar to those described in U.S. Pat. No. 5,375,550. These platforms may include a closely packed array of vertical concrete cylinders, each of which includes an open bottom and a capped top that combine to form a working platform. The air trapped in the cylinders, when pressurized, displaces water from the cylinders providing buoyancy for the platform. Air in the cylinders may also be in air or gaseous communication with adjacent cylinders via orifice passages/ducts. The compressibility of the air and its ability to move from one cylinder to an adjacent cylinder helps to desensitize or decouple the platform from buoyant wave excitations.

BRIEF DESCRIPTION OF THE DRAWINGS

The invention is illustrated by way of example and not by way of limitation in the figures of the accompanying drawings, in which the like references indicate similar elements and in which:

FIG. 3. Illustrates a vertical transverse sectional view of a floating platform in accordance with an embodiment of the present invention;

FIG. 4. Illustrates a plan view of a portion of a floating platform in accordance with an embodiment of the present invention.

DETAILED DESCRIPTION OF EMBODIMENTS OF THE INVENTION

Figure 1:
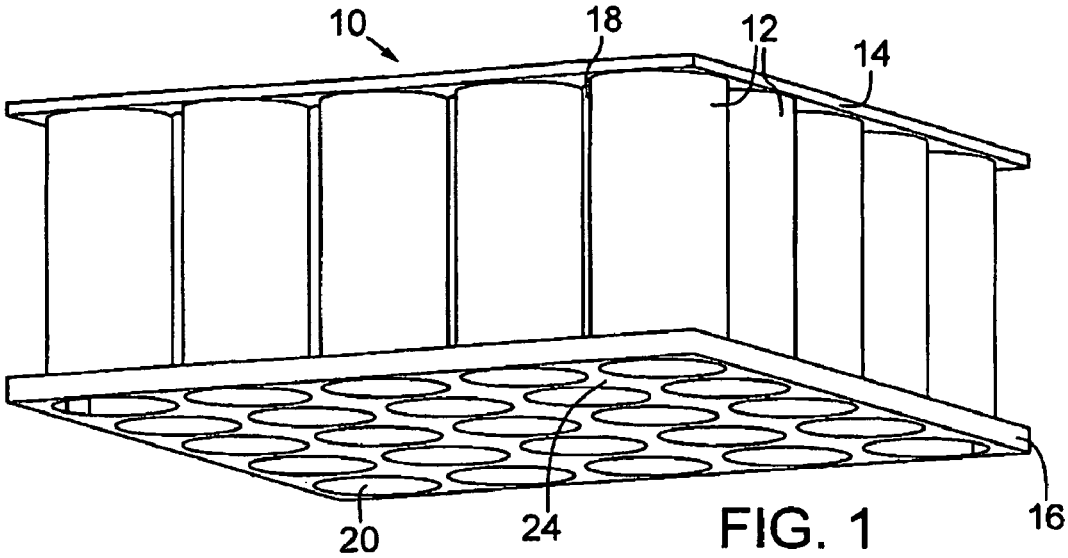
FIG. 1 illustrates a bottom perspective view of a floating platform in accordance with an embodiment of the present invention.

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Embodiments in accordance with the present invention may be particularly beneficial for large area floating platforms, and may provide a floating platform that includes a continuous or semi-continuous, substantially horizontal bottom plate structure that may be substantially parallel and interconnected with a top plate by a plurality of buoyancy members, which may be cylindrically tubular and/or polygonally tubular (e.g. have three or more sides). The bottom plate may provide the platform with an area-balanced structure that may enhance the platform's ability to resist even the most severe wave- and load-induced bending moments, as well as other naturally and unnaturally induced stresses. Structural members may also be supplied to the bottom plate to help counter certain stresses typically encountered in floating platform applications.

Embodiments in accordance with the present invention may also include a floating platform having certain fixed non-variable displacement interstitial volumes closed at their bottoms by the bottom plate and disposed between and among the open-bottomed buoyancy members. These interstitial volumes may provide an adequate reserve of buoyancy to support the platform with freeboard (i.e. keep the top deck/platform above the water line) in the highly unlikely event of complete or significant loss of variable buoyancy. In one embodiment, the closed interstitial spaces may provide at least one-quarter of the fixed, non-variable displacement volume of the floating platform.

In another embodiment in accordance with the present invention, interstitial volumes may be in air communication with the open-bottomed buoyancy members. This may allow for free and/or controlled communication of compressed air in selected variable buoyancy members to flow between the buoyancy members and one or more surrounding interstitial volumes. Such air communication may substantially increase the volume-related pneumatic compliance of the buoyancy members and help reduce the heave motion that may be caused by longer wave excitations.

Embodiments in accordance with the present invention may also include a selected array of interstitial volumes and buoyancy members that may be selectively interconnected with another selected array of interstitial volumes and buoyancy members. So connected, air migration can be controllably distributed to certain arrays as needed to better counteract various wave excitations and their affects on the platform. Networking the various buoyancy members and interstitial volumes may also enable controllable distribution of air to certain areas to counteract serious accidental damage or increase a platform static load capacity. Selected arrays may be strategically positioned across the floating platform area and interconnected in order to help maximize the compliance-related transport of air while preserving a substantially level attitude of the platform in the event of asymmetric damage with consequent loss of buoyancy air.

FIG. 1 illustrates a bottom perspective view of a floating platform in accordance with an embodiment of the present invention. Floating platform 10 may include a plurality of variable buoyancy members 12 grouped in an array. The variable buoyancy members 12 may be joined to a top cap/plate. Top caps, when assembled into an array, may combine to form the platform top 14, which may provide the working base for desired floating platform operations.

Variable buoyancy members 12 may be tubular shaped columns that project downwardly into and below a surface of a body of water in which floating platform 10 is disposed. The buoyancy members may be made of steel reinforced concrete, or other suitable construction materials, including, but not limited to steel and/or other various metal alloys, synthetic materials, such as carbon fiber reinforced polymers, and the like. Variable buoyancy members 12 may have an opposite end 20 that is open and able to allow water to enter the hollow portion of the variable buoyancy members 12. Air in the variable buoyancy members 12 may displace water inside the variable buoyancy members 12 (internal water) to a depth greater than the external water level, and may controllably provide buoyancy via the air volume's pressure to resiliently support the platform 10. It can be appreciated that buoyancy members 12 may be comprised of any suitable building materials, such as reinforced concrete and/or steel, and may be of any simple or complex geometry, including, but not limited to a variety of polygonal cross sections.

Buoyancy members 12 may be at least partially joined together by a bottom plate 16, such that some or all of the open ends 20 of the variable buoyancy members 12, remain open to the water such that water can enter the buoyancy members 12. In one embodiment, bottom plate 16 may have strength qualities substantially equal to that of the top plate 14, which may help resist the bending and torsion moments experienced by platform 10 in certain sea states and provide a stabilizing effect for the platform.

Vertical partitions 18 may be disposed longitudinally and laterally between adjacent variable buoyancy members 12, in order to connect one variable buoyancy member 12 to an adjacent variable buoyancy member. Interconnection of adjacent variable buoyancy members 12 by vertical partitions 18, when combined with top plate 14 and bottom plate 16, may define interstitial volumes 24. Interstitial volumes 24 may be made controllably watertight and/or air-tight. When water tight, interstitial volumes 24 may provide sufficient reserve buoyancy for the floating platform 10 to keep the top platforms substantially above the water line in the event that some or all of the variable buoyancy members fail. It can be appreciated that bottom plate 16 may be configured such that the number of interstitial volumes 24, and thus the reserve buoyancy, may be selectively controlled.

The interstitial volumes and variable buoyancy members may also aid in resisting forces applied or enhanced by extreme and/or unbalanced deck loads. For example, air may be directed to selected variable buoyancy members and/or interstitial volumes in a certain area where downward force on a deck is greater than normal. Examples of such situations may be where large machinery is stored, or to counteract the effect of drill strings, anchor lines, etc. Such variable loading of selected interstitial volumes and/or variable buoyancy members with air may increase the loading capacity in certain areas of the platform, in that the amount of downward force that may be applied in the desired area may be increased without increasing the thickness of the platform top plate. The air pressure in the variable buoyancy members may also be increased to raise the platform height relative to the water. This may be useful for certain ship-to-platform operations, for maintaining tension on a oil production riser, to avoid wave slapping in heavy weather and to facilitate towing. The addition of compressed air in desired locations may be introduced by a high volume low pressure compressor, such as a Roots Blower.

Controllably charging the interstitial volumes 24 with compressed air such that the air pressure in the interstitial volumes 24 is maintained at a pressure greater than or equal to that of the pressure created by the water submergence within any of the variable buoyancy members 12, may also significantly increase the material strength of the buoyancy members 12. Particularly where buoyancy members 12 are constructed of materials such as reinforced concrete, keeping a positive pressure on the outer walls may counteract or alleviate tangential tensile wall stresses created by the increase of air pressure within the buoyancy members 12.

In another embodiment in accordance with the present invention, the interstitial volumes 24 may be enlarged as needed by increasing the width of the vertical partitions 18 and correspondingly increasing the spacing between adjacent variable buoyancy members 12. Increasing the interstitial volume 24 may increase the proportion of fixed buoyancy to variable buoyancy, which in turn provides more reserve buoyancy if needed in the event of a failure.

In one embodiment in accordance with the present invention, the interstitial volumes may be interconnected with the adjacent variable buoyancy members. Allowing adjacent buoyancy members to be in air communication with an interstitial volume may result in a substantial increase of the volume-related pneumatic compliance of the buoyancy members against wave generated heave and other potential forces created by wave excitations and/or external sources.

Embodiments in accordance with the present invention may enable the construction of platforms so large as to result in relatively calm waters on the leeward side of the platform. This leeward calming may also allow other floating vessels to dock adjacent to the floating platform, such that the relative motion between the docked vessel and the floating platform is minimized. This increases safety and facilitates the loading, unloading, fueling, and other vessel-to-platform type operations.

Figure 2:
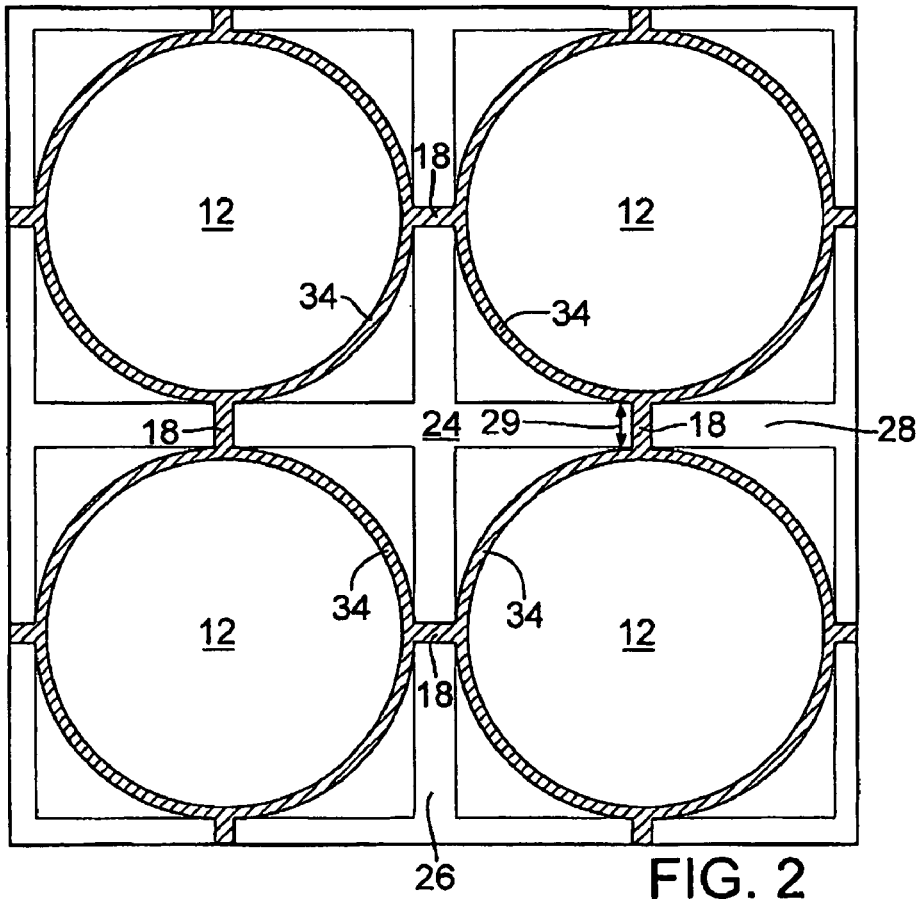
FIG. 2 illustrates horizontal sectional plan view of a floating platform in accordance with an embodiment of the present invention.

FIG. 2 illustrates an enlarged sectional horizontal plan view of a floating platform in accordance with an embodiment of the present invention. Four vertical variable buoyancy members 12 are shown. Vertical partitions 18 may be disposed between and interconnect variable buoyancy members 12, to create interstitial volume 24. Interstitial volume 24 may be increased or decreased depending on platform configuration and/or buoyancy needs by increasing or decreasing the width 29 of vertical partitions 18.

The floating platform may be reinforced with beams 26 and 28, which may extend laterally and longitudinally across a lower portion of the platform. Beams 26 and 28 may intersect vertical partitions 18 at or near the bottom of the buoyancy members 12. Beams 26 and 28 may be integral with the bottom plate 16, in order to provide additional strength to the bottom portion of the floating platform. It can be appreciated that beams 26 and 28 may intersect (as shown) or may be of different heights and widths such that they overlap at their intersection.

In one embodiment, the air within interstitial volumes 24 may be maintained at a pressure equal to or greater than the pressure inside variable buoyancy members 12. Maintaining such a positive pressure within surrounding interstitial volumes 24 may result in a generally circumferential compressive stress/force on walls 34 of that buoyancy member 12. This compressive stress may help the walls of the variable buoyancy members resist tensile stress cracking or problems resulting from forces imposed as a result of elevated pressure within the variable buoyancy members 12.

FIG. 3. illustrates an enlarged cross sectional view of the floating platform of FIG. 2 in accordance with an embodiment of the present invention. One or more tendons 32 may be positioned in beams 26 and 28, as well as the top surface plate 14. Tendons 32 may include, but are not limited to, members that may apply post-tension to structures to insure that the material, such as reinforced concrete material, remains in a state of compressive stress in the presence of the largest expected bending moment load in the platform.

It can be appreciated that the height 27 of the beams 26 and 28 may vary depending on the platform configuration and the amount and types of stresses that may be incurred by the floating platform. For example, if a platform is longer in the direction for which beams 26 are running, beams 26 may be larger than beams 28 in order to withstand the added stress due to the longer span.

FIG. 4 illustrates an enlarged plan view of a portion of a floating platform in accordance with an embodiment of the present invention. Several variable buoyancy members 112 may be configured in an array. Variable buoyancy members 112A and 112B may be interconnected by an airduct 108 and further interconnected to interstitial volumes 124A and 124B. Air, for example, may be controllably allowed to communicate freely through airduct 108 with the interstitial volumes 124. Such interconnection of the interstitial volumes 124A and 124B with the buoyancy members 112A and 112B may result in a substantial increase of the volume-related pneumatic compliance of the buoyancy members 112 against wave generated heave forces, as well as other potential forces that may be encountered by the floating platform.

As previously discussed, and by way of example, where the water level within buoyancy members 112A and 112B is rising, such as a result of the passing peak of a wave, air may flow from the buoyancy members 112A and 112B into interstitial volumes 124A and 124B, as shown by arrows 106. The direction and magnitude of the air flow between buoyancy members 112A and 112B may vary depending on the raising and lowering of the water levels in the buoyancy members, which in turn may increase and decrease the air pressure respectively. Using interstitial volumes 124A and 124B to increase in variable buoyancy volume may not only better stabilize the floating platform to the effects of wave excitation.

In another embodiment in accordance with the present invention, air flow may be directed to other parts of the floating platform through airduct 108, as shown by arrows 104. The arrows generally indicate the direction of short-term air flow during a rising water level in the cylinders. This may enable the air to be routed to various buoyancy members and interstitial volumes that are interconnected, but remotely located. Such movement may thus enhance compliance by means of air mobility and reduces platform motions and structural loading in the event of significant wave activity.

Figure 5:
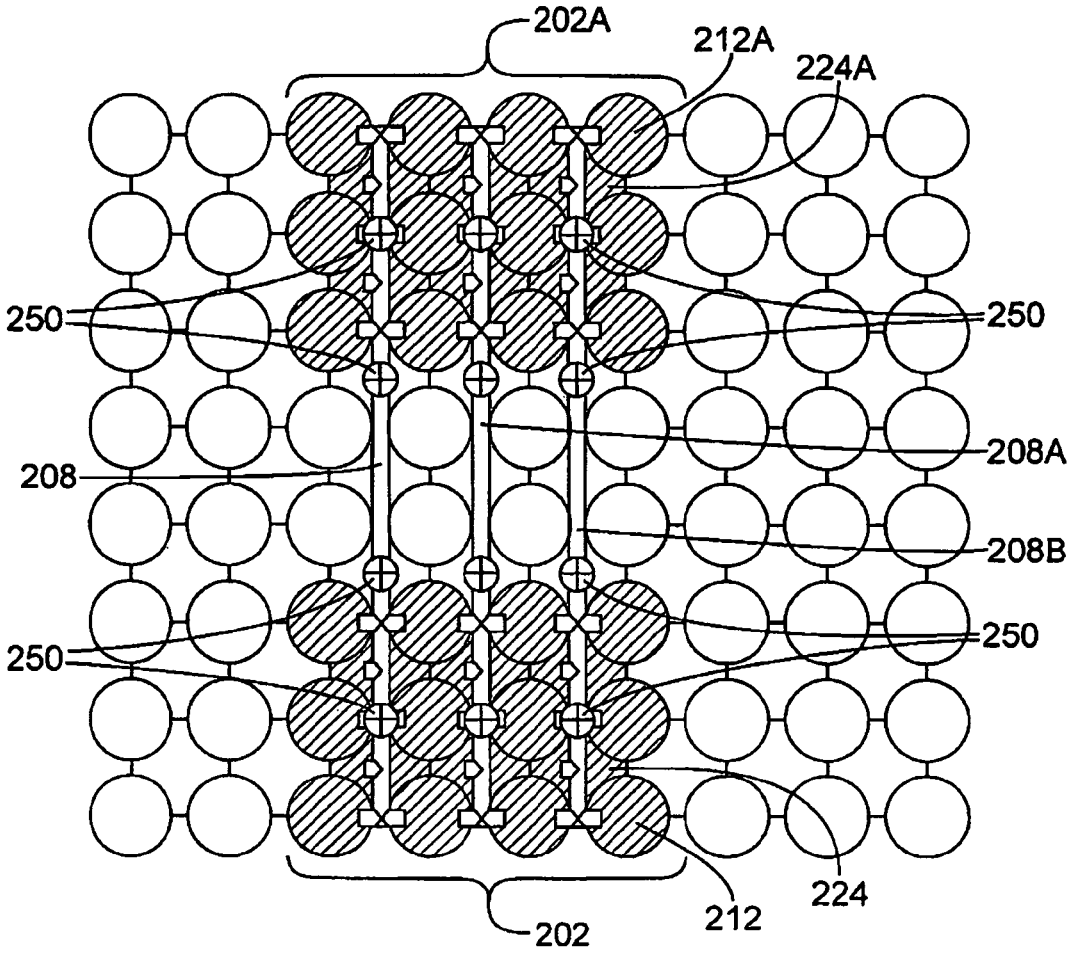
FIG. 5. Illustrates a large scale plan view of a portion of a floating platform in accordance with an embodiment of the present invention.

FIG. 5 Illustrates a plan view of a floating platform in accordance with an embodiment of the present invention. In one embodiment, a selected array of buoyancy members may be interconnected to a like array of buoyancy members positioned at different locations of the floating platform, which may aid in wave decoupling through the mobility of buoyancy air to different parts of the floating platform.

In one embodiment, air may be controllably ducted through airducts 208, 208A and 208B between a first array 202 to a second array 202A. In one embodiment, second array 202A may be symmetric in size and number of buoyancy members and interstitial volumes to that of first array 202. Likewise, second array 202A may be symmetrically situated across the width and/or across the length of the floating platform with respect to first array 202. It can be appreciated, however, that the number and position of arrays may be selected as needed to accommodate particular applications.

Air mobility may be enhanced when the distance between arrays 202 and 202A is adequate to encompass a significant gradient in wave elevation and length. Distancing first array 202 from second array 202A may serve to enhance the compliance-related transport of air while preserving the level attitude of the platform in the event of asymmetric damage, for example, with consequent loss of buoyancy air.

In one embodiment, a network of valves 250 may be positioned in ducts 208, 208A and 208B that may be selectively actuatable to change the array configurations, and may enable, disable, enhance or reduce the effects of air mobility and control. High volume low pressure compressors may also be coupled to the network of valves and ducting to controllably introduce additional compressed air in various arrays, buoyancy members, and/or interstitial volumes as needed to provide necessary support for the floating platform generally or to localized areas.

It can be appreciated that floating platforms in accordance with embodiments of the present invention may be well suited for constructing very large area floating platforms. Several platform segments or modules may be joined together and structurally supported by the top and bottom plate structures. These larger platforms may be sufficiently stable to allow such activities as landing and takeoff of aircraft, docking of ships for loading and unloading cargo and/or personnel.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimded is:

1. A floating platform, comprising:

a top plate;

a plurality of variable buoyancy members configured in an array, each variable buoyancy member having an open bottom end, and a closed top end coupled to the top plate, wherein two or more variable buoyancy members are in controlled communication such that a flow of air between the two or more variable buoyancy members is controllable;

a plurality of vertical partitions, each laterally and longitudinally interconnecting two or more of the plurality of variable buoyancy members;

a bottom plate configured to leave at least one open bottom end of at least one variable buoyancy member exposed to a volume of water; and at least one interstitial volume defined by the vertical partitions interconnecting three or more variable buoyancy members, the at least one interstitial volume being sealed to prevent inflow of the volume of water into the interstitial volume.

2. The floating platform of claim 1, further comprising a network of beams disposed about the variable buoyancy members substantially at or near the bottom end of the variable buoyancy members.

3. The floating platform of claim 2, wherein the bottom plate and the network of beams has a strength and rigidity that is substantially the same as a strength and rigidity of the top plate such that the floating platform has an area-balanced structure capable of resisting ocean wave-induced and platform load-induced bending moments.

4. The floating platform of claim 1, wherein one or more of the interstitial volumes are a fixed, non-variable displacement volume that provides enough buoyancy to float the platform in the event of a total loss of variable buoyancy in the buoyancy members.

5. The floating platform of claim 1, wherein the interstitial volumes have a first pressure and the buoyancy members have a second pressure.

6. The floating platform of claim 5, wherein the first pressure is controlled to remain substantially equal to or less than the second pressure.

7. The floating platform of claim 1, wherein the interstitial volumes are increased by increasing a width of the vertical partitions to increase separation of the variable buoyancy members, and/or by increasing the length of the vertical partitions.

8. The floating platform of claim 1, wherein at least one interstitial volume is connected to at least one adjacent variable buoyancy member to allow air communication there between and increase an available volume of the at least one variable buoyancy member.

9. The floating platform of claim 1, wherein an air supply is coupled to the interstitial volumes and/or the variable buoyancy members and configured to controllably supply the air to the interstitial volumes and/or the variable buoyancy members, either separately or together, thereby increasing the pressure in the interstitial volumes and/or in the variable buoyancy members.

10. The floating platform of claim 9, wherein said pressure is increased in a localized area to provide a higher load capacity for the top plate in the localized area.

11. The floating platform of claim 9, wherein said pressure in the variable buoyancy members is increased to raise the floating platform in the volume of water.

12. The floating platform of claim 1, further comprising:

a first array of variable buoyancy members and interstitial volumes;

a second array of buoyancy members and interstitial volumes;

one or more airducts interconnecting one or more buoyancy members and/or one or more interstitial volumes of the first array with one or more buoyancy members and/or one or more interstitial volumes of the second array; and a network of valves placed within the one or more airducts to controllably allow air to exchange between the first array and the second array.

13. The floating platform of claim 12, wherein the first array and the second array are symmetrical in size and position within the floating platform.

14. The floating platform of claim 12, wherein air may be moved from the first array to the second array to compensate for a temporary loss of variable buoyancy in the second array.

15. The floating platform of claim 1, wherein the platform has a windward side and a leeward side, and wherein the plurality of variable buoyancy members are adapted to attenuate a wave activity as it passes beneath the floating platform from the windward side to the leeward side.

16. The floating platform of claim 15, wherein the leeward side is adapted to dock vessels.

17. The floating platform of claim 9, wherein the air is provided by a high volume low pressure compressor.

18. A floating platform, comprising:

a top plate;

a plurality of variable buoyancy members configured in an array, each variable buoyancy member having an open bottom end, and a closed top end coupled to the top plate;

a plurality of vertical partitions, each laterally and longitudinally interconnecting two or more of the plurality of variable buoyancy members;

a bottom plate configured to leave at least one open bottom end of at least one variable buoyancy member exposed to a volume of water;

at least one interstitial volume defined by the vertical partitions interconnecting three or more variable buoyancy members, the at least one interstitial volume being sealed to prevent inflow of the volume of water into the interstitial volume;

wherein the array of variable buoyancy members include, a first array of variable buoyancy members and interstitial volumes, and a second array of buoyancy members and interstitial volumes;

one or more air ducts interconnecting one or more buoyancy members and/or one or more interstitial volumes of the first array with one or more buoyancy members and/or one or more interstitial volumes of the second array; and a network of valves placed within the one or more airducts to controllably allow air to exchange between the first array and the second array.

19. The floating platform of claim 18, wherein the first array and the second array are symmetrical in size, shape and position within the floating platform.

20. The floating platform of claim 18, wherein air may be moved from the first array to the second array to compensate for a temporary loss of variable buoyancy in the second array.

* * * * *